United States Patent [19]

Morgan et al.

[11] Patent Number: 4,846,113

[45] **Date of Patent: * Jul. 11, 1989**

[54] POWER SOURCE UTILIZING LITHIUM AND PERHALOGENATED POLYMERS

[75] Inventors: David Morgan, Rockford, Ill.; Donald A. Straznickas, deceased, late of Rockford, Ill., by Barbara A. Straznickas, executor

[73] Assignee: Sundstrand Corporation, Rockford, Ill.

[ * ] Notice: The portion of the term of this patent subsequent to Sep. 11, 2005 has been disclaimed.

[21] Appl. No.: 813,785

[22] Filed: Dec. 27, 1985

[51] Int. Cl.[4] ..... F22B 1/00

[52] U.S. Cl. ..... 122/21; 122/4 R; 149/19.3

[58] Field of Search ..... 122/4 R, 21, 4 D; 149/19.3; 427/216

[56] References Cited

U.S. PATENT DOCUMENTS

| | | | |
|---|---|---|---|
| 2,978,308 | 4/1961 | Keller . | |
| 3,156,595 | 11/1964 | Camp et al. . | |
| 3,159,104 | 12/1964 | Hodgson . | |
| 3,441,455 | 4/1969 | Woods et al. . | |
| 3,791,889 | 2/1974 | Schroder . | |
| 3,995,559 | 12/1976 | Bice et al. . | |
| 4,671,211 | 6/1987 | Buford | 122/21 X |
| 4,714,051 | 12/1987 | Buford | 122/21 |
| 4,794,682 | 1/1989 | Buford | 122/21 X |

*Primary Examiner*—Edward G. Favors

*Attorney, Agent, or Firm*—Wood, Dalton, Phillips, Mason & Rowe

[57] ABSTRACT

The expense of provide pelletized metallic lithium for use in a heat exchanger for a thermal power source is eliminated by a construction including a closeable chamber (10, 12, 20, 22) with an ignition device (28) within the chamber (10, 12, 20, 22), and a reactant inlet (29) to the chamber (10, 12, 20, 22) by disposing a body of fuel (24) in the chamber (10, 12, 20, 22) which is made up of alternating layer of metallic lithium sheet (42, 44) and solid perhalogenated polymer sheet (40, 46).

14 Claims, 1 Drawing Sheet

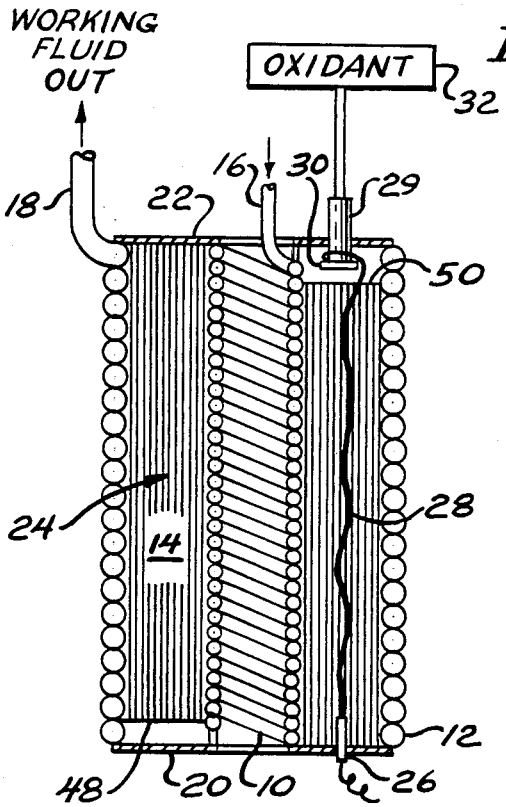
FIG. 1
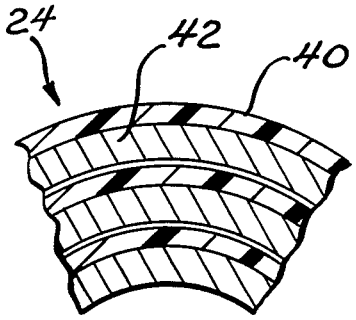
FIG. 2
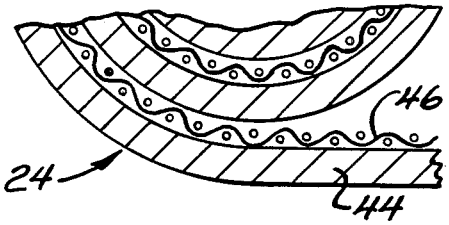
FIG. 3
FIG. 4
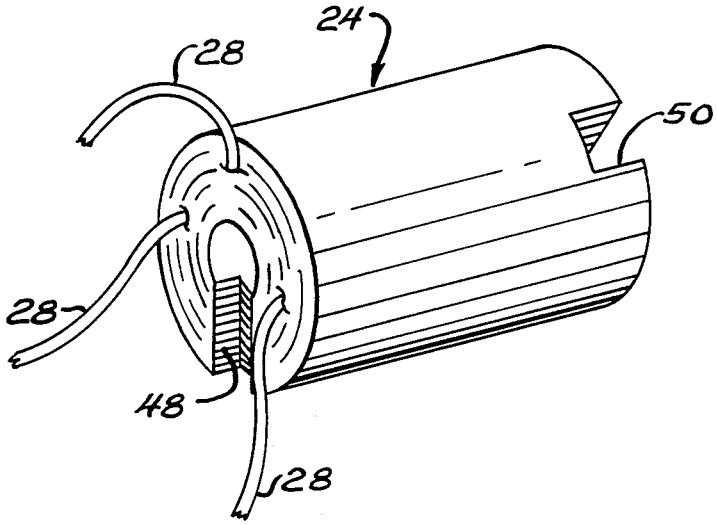

POWER SOURCE UTILIZING LITHIUM AND PERHALOGENATED POLYMERS

FIELD OF THE INVENTION

This invention relates to a power or heat source wherein lithium sheets are sandwiched by sheets formed of a solid perhalogenated polymeric material and are oxidized to provide heat.

BACKGROUND ART

Over the years, a variety of power or energy sources operating off of heat derived from the oxidation of metallic lithium have been proposed. See, for example, U.S. Pat. No. 3,329,957 issued July 4, 1967 to Rose. In such a system, water and lithium are reacted to produce lithium hydroxide, hydrogen and steam. Elsewhere in the system, the hydrogen generated by the reaction between lithium and water is combined with oxygen to provide additional steam. The steam is then utilized to drive a turbine or the like to provide a source of power.

Other proposals have been made wherein lithium is oxidized for the purpose of providing heat in nonspecific environments. Examples may be found in Camp et al U.S. Pat. No. 3,156,595 issued Nov. 10, 1964 and Biermann U.S. Pat. No. 3,963,541 issued June 15, 1976. These proposals utilize lithium and/or lithium alloys as a fuel which is oxidized by sulfur hexafluoride. According to Biermann, lithium powder of a very small size is coated with a perhalogenated compound prior to being oxidized with sulfur hexafluoride.

More recently, systems have been proposed wherein metallic lithium, in the solid phase and as a generally solid block, is placed within an oxidation chamber of a boiler. When power is desired, the lithium is melted and oxidized with sulfur hexafluoride. The resultant heat vaporizes a working fluid, typically water, in a working fluid chamber in heat exchange relation with the oxidation chamber of the boiler. Again, a turbine may be driven by the working fluid.

While such a system is effective, it is not without its drawbacks. Typically, the system start is initiated by firing a thermal starting device which includes aluminum potassium perchlorate. The intention is to heat the thermal mass of the boiler and the lithium fuel therein to operating temperature and to this end, the aluminum potassium perchlorate generates extremely high temperatures, typically in the range of 5,400°–8,500° F. Substantial pressures may be generated during the ignition of the aluminum potassium perchlorate requiring high strength in the boiler structure. Furthermore, the aluminum potassium perchlorate, should it contact boiler surfaces or sulfur hexafluoride injection nozzles, can burn through the same resulting in system damage.

In the commonly assigned applications of Buford, respectively U.S. Ser. No. 618,893 filed June 8, 1984, U.S. Pat. No. 4,634,479 and entitled "Power Source Utilizing Encapsulated Lithium Pellets and Method of Making Such Pellets" and U.S. application Ser. No. 733,049 filed May 13, 1985 U.S. Pat. No. 4,671,211 and bearing the same title, the details of which are herein incorporated by reference, to the various difficulties presented by the various prior art approaches mentioned previously are dealt with by utilizing metallic lithium in shot shape and size or spherical form. Such lithium pellets are coated with a predominantly fluorine substituted, perhalogenated polymeric material and are ultimately oxidized with sulfur hexafluoride. These components eliminate any need for aluminum potassium perchlorate starters and the attendant problems. Moreover, by appropriately selecting the size of the pellets, the ullage or void volume within the oxidation chamber can be controlled so as to readily accommodate the expansion of the lithium metal that occurs as the progression of the reaction raises the temperature of the lithium from the ambient to an elevated temperature.

At the same time, however, the coating of the lithium pellets with polymer is not an inexpensive procedure, nor is the formation of metallic lithium into pellets since there is no known concurrent need in other areas for lithium pellets.

The present invention is directed to overcoming one or more of the above problems.

SUMMARY OF THE INVENTION

It is the principal object of the invention to provide a new and improved heat or energy source including a heat exchanger utilizing lithium metal. More specifically, it is an object of the invention to provide such a power source utilizing lithium metal and a perhalogenated polymer in which optionally may avoid the expense of a coating procedure in which completely avoids the expense of pelletizing the lithium metal.

An exemplary embodiment of the invention achieves the foregoing objects in a thermal power source including a closeable chamber. An ignition device is disposed in the chamber and the chamber is provided with a reaction inlet. A body of fuel is disposed in the chamber and is comprised of alternating layers of metallic lithium sheet and solid, perhalogenated polymer sheet.

In a preferred embodiment, the polymer is predominantly fluorine substituted.

Usually, but not always, the body is made up of spirally wound ones of the layers.

According to one embodiment, the polymer sheet is coated on the lithium sheet.

In a highly preferred embodiment, the polymer sheet is separate from the lithium sheet. The polymer sheet in such an embodiment may constitute a fabric, either woven or felted.

In a preferred embodiment, the body of fuel is formed by spirally winding the layers on an ignition device.

The invention contemplates that the fuel body may be provided with cut outs to attain a desired ullage within the chamber. Additionally, where the fuel body is wound, ullage may be controlled by the tightness of the wind.

Alternatively, or additively, where the reaction chamber inlet comprises a nozzle as, for example, sulfur hexafluoride injectors, the cut out may be disposed at the nozzles to permit dispersion of the oxidant throughout the chamber.

In a highly preferred embodiment, the lithium sheet is lithium foil, a form of lithium readily available in view its present use in the manufacture of batteries.

Other objects and advantages will become apparent from the following specification taken in connection with the accompanying drawings.

DESCRIPTION OF THE DRAWINGS

FIG. 1 is a sectional view of a heat exchanger or thermal power source made according to the invention;

FIG. 2 is an enlarged, fragmentary view of one form of fuel body utilized in the invention;

FIG. 3 is an enlarged, fragmentary view similar to FIG. 2 showing another form of fuel body that may be utilized in the invention; and FIG. 4 is a view of a completed fuel body prior to its being placed in a heat exchanger.

DESCRIPTION OF THE PREFERRED EMBODIMENT

An exemplary embodiment of a heat exchanger made according to the invention is illustrated in FIG. 1 and includes an interior wall defined by a small diameter, coiled tube 10 surrounded by a large diameter coiled tube 12. The tubes 10 and 12 are generally concentric but spaced so as to define an annular, fuel receiving space 14.

The tubes 10 and 12 are also in fluid communication with each other by any suitable means (not shown) with the tube 10 being provided with a working fluid inlet 16 and the tube 12 being provided with a steam outlet 18. The annulus or space 14 between the tubes 10 and 12 is sealed by any suitable means including, for example, end plates 20 and 22. The resulting structure defines a closeable boiler in which a working fluid, such as water, may be introduced through the inlet 16 and evaporated by the heat of a chemical reaction which occur within the annulus or space 14 to steam which exits the outlet 18 conveyed to a point of use as, for example, a turbine.

Within the annulus 14 is a body of fuel, generally designated 24, to be described in greater detail hereinafter.

The end plate 20 may be provided with one or more electrical connectors 26 whereby a so-called "SCID" wire 28 may be located within the body of fuel 24. The wire 28 is a thermal starting device as is well known and serves to initiate the reaction to occur within the space without posing the problems associated with aluminum potassium perchlorate starter.

The end plate 22 mounts one or more oxidant inlets 29 in the form of nozzles having caps 30 soldered thereon. To obtain the proper mixing of the moltant lithium, oxidant nozzles (not shown) may also be mounted on end plate 20. In a preferred embodiment, the SCID wire 28 may be wound around the interface of the nozzles 29 and the soldered caps 30. Thus, upon activation of the SCID wire 28, the resulting heat will melt the solder at the junction of the cap 30 and the nozzle 29 allowing the former to be blown free of the latter by an incoming stream of oxidant from a tank shown schematically at 32. As alluded to previously, the oxidant will typically be sulfur hexafluoride.

FIGS. 2, 3 and 4 illustrate forms of the body of fuel 24 in greater detail. According to the invention, the body of fuel is made up by alternating layers of metallic lithium sheets and sheets of solid perhalogenated polymer, which polymer will preferably be predominantly fluorine substituted and generally entirely fluorine substituted as, for example, polytetrafluoroethylene and polyperfluoroalkoxy compounds. Other solid polymers and telomers that are generally perhalogenated may be utilized as is known in the art.

According to one embodiment of the invention, the polymer sheet, which is shown at 40 in FIG. 2, is coated on a lithium sheet 42 and the thus coated lithium sheet 42 spirally wound to provide the desired alternating layers of lithium and polymer. When coating is employed, a particularly preferred compound is that sold under the registered trademark VYDAX, and specifically VYDAX 550. This material is understood to be a fluorine end capped tetrafluoroethylene telomer dispersed in a trichloro-trifluoroethane solvent.

The lithium sheet may be coated with the telomer material, generally in a diluent such as freon, and the diluent and solvent evaporated to provide the sheet-like layer 40.

Alternatively, the polymer sheet may be separate from the lithium sheet; and such an arrangement is shown in FIG. 3. In FIG. 3, the lithium sheet is shown at 44 and the polymeric sheet shown at 46 in the form of a woven fabric. The fabric need not be woven but could be felted or simply, a homogenous "foil". In any event, the filaments, fibers or foil making up the sheet 46 are made up of the previously identified perhalogenated polymers. In this embodiment, which is preferred, both the lithium and the polymer can be shipped and stored separately prior to final assembly which is advantageous in terms of separating the lithium fuel from polymer which may act as an oxidant under certain conditions as set forth in the previously identified applications of Buford. Furthermore, use of the embodiment illustrated in FIG. 3 avoids coating procedures as disclosed by Buford or as utilized in construction of the FIG. 2 embodiment shown herein, and thus is advantageous from the economic standpoint.

FIG. 4 illustrates a completed fuel body 24. As can be seen, from one end, a number of the SCID wires 28 extend, it being preferred to roll the combined sheets 40, 42 or the separate sheets 44, 46 upon the SCID wires as the body is being made up. This is considered to provide an assembly of fuel and starters that is less subject to failure as a result of vibration and/or shock during storage, handling and/or initial deployment activity.

FIG. 4 also illustrates the presence of cutouts or holes 48 and 50 in opposite ends of the body of fuel 24. The cut outs 48 may be utilized, for example, to control the ullage of the space 14 so as to allow appropriate thermal expansion of the fuel during initiation of the reaction without placing high mechanical pressures on the components of the heat exchanger. The cut out 50 may be utilized for the same purpose or alternatively, or additively for the purpose of allowing free discharge of the caps 30 from the nozzles 29. In particular, as seen in FIG. 1, the cut out 50 is aligned with the cap 30 allowing the cap to release easily from the nozzle 29 and permitting the oxidant from the nozzle 29 to disperse within the general area of the fuel body at the cut out 50.

From the foregoing, it will be seen that a heat exchanger made according to the invention possesses all the advantages of those disclosed by Buford with additional advantages as well in terms of optionally eliminating a step of coating the metallic lithium. Further, the expense of the step of pelletizing the metallic lithium is avoided. Rather, readily available lithium sheet, customarily in foil form as is commonly used in battery production, may be utilized instead. Since the availability of such lithium foil is considerably greater than that of pellets, the expense of producing a heat exchanger according to the invention is considerably reduced.

The invention also provides for excellent ullage control in a very simple fashion. Furthermore, by disposing the SCID wires between the inner leaved layers constituting the body of fuel 24, greater reliability is expected.

What is claimed is:

1. A heat exchanger for a thermal power source comprising;

a closeable chamber;

an ignition device in said chamber;

a reactant inlet to said chamber; and a body of fuel in said chamber comprised of alternating layers of metallic lithium sheet and solid perhalogenated polymer sheet.

2. The heat exchanger of claim 1 wherein said polymer is predominantly fluorine substituted.

3. The heat exchanger of claim 2 wherein said body is made up of spirally wound ones of said layers.

4. The heat exchanger of claim 2 wherein said polymer sheet is coated on said lithium sheet.

5. The heat exchanger of claim 2 wherein said polymer sheet is a fabric.

6. The heat exchanger of claim 2 wherein said body is formed by spirally winding said layers on said ignition device.

7. The heat exchanger of claim 2 wherein said body is provided with cut outs to attain a desired ullage within said chamber.

8. The heat exchanger of claim 2 wherein said reactant inlet comprises nozzles, and said body is provided with cut outs at said nozzles.

9. The heat exchanger of claim 2 wherein said lithium sheet is lithium foil.

10. The heat exchanger of claim 1 wherein said chamber includes means defining a liquid flow path.

11. A vessel for use in a power generating system including:

a reaction chamber;

a working fluid heating chamber in heat exchange relation to said reaction chamber;

at least one oxidant nozzle within said reaction chamber for introducing an oxidant into said reaction chamber; and a body of fuel in said reaction chamber comprised of interleaved sheets of lithium metal and solid perhalogenated predominantly fluorinated polymeric material.

12. The vessel of claim 11 wherein said sheets are spirally wound to encompass an ignition device and include at least one cut out about said nozzle, said cut out allowing oxidant to disperse within said reaction chamber and being sized to provide a desired ullage therein.

13. The vessel of claim 12 wherein said sheet of polymeric material is formed by coating said polymeric material on said lithium sheet.

14. The vessel of claim 12 wherein said sheets are separate from one another.

* * * * *